US009345320B2

(12) United States Patent
Calderone

(10) Patent No.: US 9,345,320 B2
(45) Date of Patent: May 24, 2016

(54) BED TABLE RETRACTABLE TO BE CONCEALED ADJACENT A BED RAIL

(71) Applicant: Joel Calderone, Long Beach, CA (US)

(72) Inventor: Joel Calderone, Long Beach, CA (US)

( * ) Notice: Subject to any disclaimer, the term of this patent is extended or adjusted under 35 U.S.C. 154(b) by 0 days.

(21) Appl. No.: 14/258,283

(22) Filed: Apr. 22, 2014

(65) Prior Publication Data

US 2015/0296977 A1 Oct. 22, 2015

(51) Int. Cl.

*A47B 23/02* (2006.01)
*A47B 23/00* (2006.01)
*A47C 21/00* (2006.01)

(52) U.S. Cl.

CPC ..... *A47B 23/025* (2013.01); *A47B 23/02* (2013.01); *A47C 21/00* (2013.01)

(58) Field of Classification Search

CPC ..... A47C 21/00; A47C 31/00; A47C 7/70; A47C 7/68; A47C 7/62; A61G 7/05; A61G 7/0503; A47B 23/00; A47B 23/02; A47B 23/025; A47B 23/046; F16M 13/02; F16M 13/00; F16M 11/10; F16M 11/06; F16M 11/04

USPC ..... 5/507.1, 503.1–506.1, 658; 108/49, 42; 297/144, 145

See application file for complete search history.

(56) References Cited

U.S. PATENT DOCUMENTS 915,651 A * 3/1909 Appel ..... 5/158
1,043,638 A * 11/1912 Sneed ..... 108/49
1,208,979 A 12/1916 Kahre
1,231,678 A 7/1917 Walker
1,248,842 A * 12/1917 Gayer ..... 108/8
1,312,274 A * 8/1919 Sculthorp ..... 108/141
1,662,675 A * 3/1928 Innes ..... 108/5
1,862,237 A 6/1932 Pepler
1,869,444 A * 8/1932 Tobey ..... 297/145
1,891,691 A * 12/1932 Runkles ..... 297/145
2,460,244 A * 1/1949 Strauss ..... 108/137
2,518,381 A * 8/1950 Runkles ..... 297/145
2,612,422 A 9/1952 Sarkus
2,635,680 A * 4/1953 Zentmire ..... 297/144
2,845,113 A * 7/1958 Keel ..... 297/145
3,543,312 A 12/1970 Pofferi
3,583,760 A * 6/1971 McGregor ..... 297/145
3,618,145 A 11/1971 Rowe
3,632,161 A * 1/1972 Arfaras et al. ..... 297/145
3,717,375 A * 2/1973 Slobodan ..... 297/162
4,834,449 A * 5/1989 Engelman ..... 297/145
4,944,552 A * 7/1990 Harris ..... 297/145
5,035,464 A 7/1991 Spallholtz
5,129,702 A * 7/1992 Ervin ..... 297/144
5,547,247 A * 8/1996 Dixon ..... 297/145
5,927,799 A * 7/1999 Tornero ..... 297/145
6,220,658 B1 * 4/2001 Lukawski et al. ..... 297/145
7,201,439 B2 * 4/2007 Schweizer ..... 297/145
7,234,182 B2 6/2007 Miller
7,509,696 B2 * 3/2009 Soto et al. ..... 5/507.1
7,798,072 B2 * 9/2010 Becker et al. ..... 108/42
7,874,614 B2 * 1/2011 Figueras Mitjans ..... 297/145
8,474,384 B2 * 7/2013 Sundarrao ..... 108/42
2005/0258672 A1 * 11/2005 Schweizer ..... 297/145
2006/0085917 A1 4/2006 Miller
2006/0220425 A1 * 10/2006 Becker et al. ..... 297/188.16
2006/0288482 A1 * 12/2006 Soto et al. ..... 5/507.1
2009/0026812 A1 * 1/2009 Figueras Mitjans ..... 297/162
2011/0067606 A1 * 3/2011 Sundarrao ..... 108/44
2015/0296977 A1 * 10/2015 Calderone ..... A47B 23/025 5/2.1
2016/0000222 A1 * 1/2016 Calderone ..... A47B 83/02 297/173

* cited by examiner

*Primary Examiner* — Robert G Santos
(74) *Attorney, Agent, or Firm* — Fulwider Patton LLP

(57) ABSTRACT

A narrow, elongated box to mount in the space between the side of a mattress and bed rail and formed with open top and front sides and a stand pivotally mounted on its lower end in the box.

21 Claims, 7 Drawing Sheets

BED TABLE RETRACTABLE TO BE CONCEALED ADJACENT A BED RAIL

BACKGROUND

The present invention relates to a bed table for use by patients confined to a bed or the like.

DESCRIPTION OF THE PRIOR ART

The problems attendant the provision of a sturdy and inexpensive bed table to be mounted directly to a bed and concealed during non-use has long plagued the art. It has been common practice that a bedridden patient will typically take his or her food from a tray which may be either rested on the bedclothes themselves, supported from the bed by foldable legs or maybe carried from a wheeled carriage which may be maneuvered about the patient's bedroom or hospital room to be moved into place positioning the table top cantilevered over the lap of the reclined patient during meal time and then wheeled away for storage in the corner of the room or the like. This, of course, creates clutter and is not preferred by hospital personnel and care givers.

The shortcomings of these devices have been repeatedly addressed by those working in the art. Various types of bedrail mounted table devices have been proposed, many of which are intended to store the table top in the space beneath the mattress during nonuse or, in some instances, store the table top behind the bed board. Examples of devices proposing under mattress storage include, for example, U.S. Pat. No. 3,543,312 to Pofferi, U.S. Pat. No. 1,862,237 to Pepler, U.S. Pat. No. 1,231,678 to Walker and U.S. Pat. No. 2,612,422 to Sarkus.

The Walker patent discloses a rather complicated mechanism including a telescopical pipe carried on its lower end from a bracket to thus mount a table top so that the table top may be lowered from its horizontal position to above the patient's lap to a horizontal position disposed beneath the bed. The Walker patent shows an angular stand pipe to be mounted with the horizontal run mounted to the bed rail and the vertical rung mounted to the angular support rod to be telescoped and pivoted relative to the stand pipe. A table top is pivotally carried from the horizontal rung of the running rod so that the stand pipe may be rotated downwardly to a lowered position to collapse the table top underneath the bed mattress. Such a device, while convenient for displaying the table over the patient's lap fails to provide sturdy support for the table top while the patient dines and requires significant space in and about and underneath the bed for orbiting of the table top to its stored position beneath the mattress.

The Sarkus U.S. Pat. No. 2,612,422 proposes a rather complicated mechanism including four knuckles and an angular table intended to be orbited about the serving position to a location behind the bed board during non-use. Such a mechanism is inherently unstable in supporting the table itself and requires significant clearance behind the bed board for manipulating the table into its storage position.

Other efforts to solve the problems has led to a proposal for a powered hospital bed including a drive mechanism to be mounted beneath the bed for powering the table from its serving position to a folded position stored underneath the bed. A device of this type is shown in U.S. Pat. No. 3,618,145 to Rowe. Such devices, while convenient if they should operate properly, are relatively complicated and expensive to manufacture and maintain.

SUMMARY OF THE INVENTION

A narrow box received in the space between the side of a mattress and a bed rail and pivotally mounting a stand for rotation for a horizontal retracted position to a raised, vertical position and a table top carried pivotally from the top of the stand.

DETAILED DESCRIPTION OF THE PREFERRED EMBODIMENTS

Figure 1:
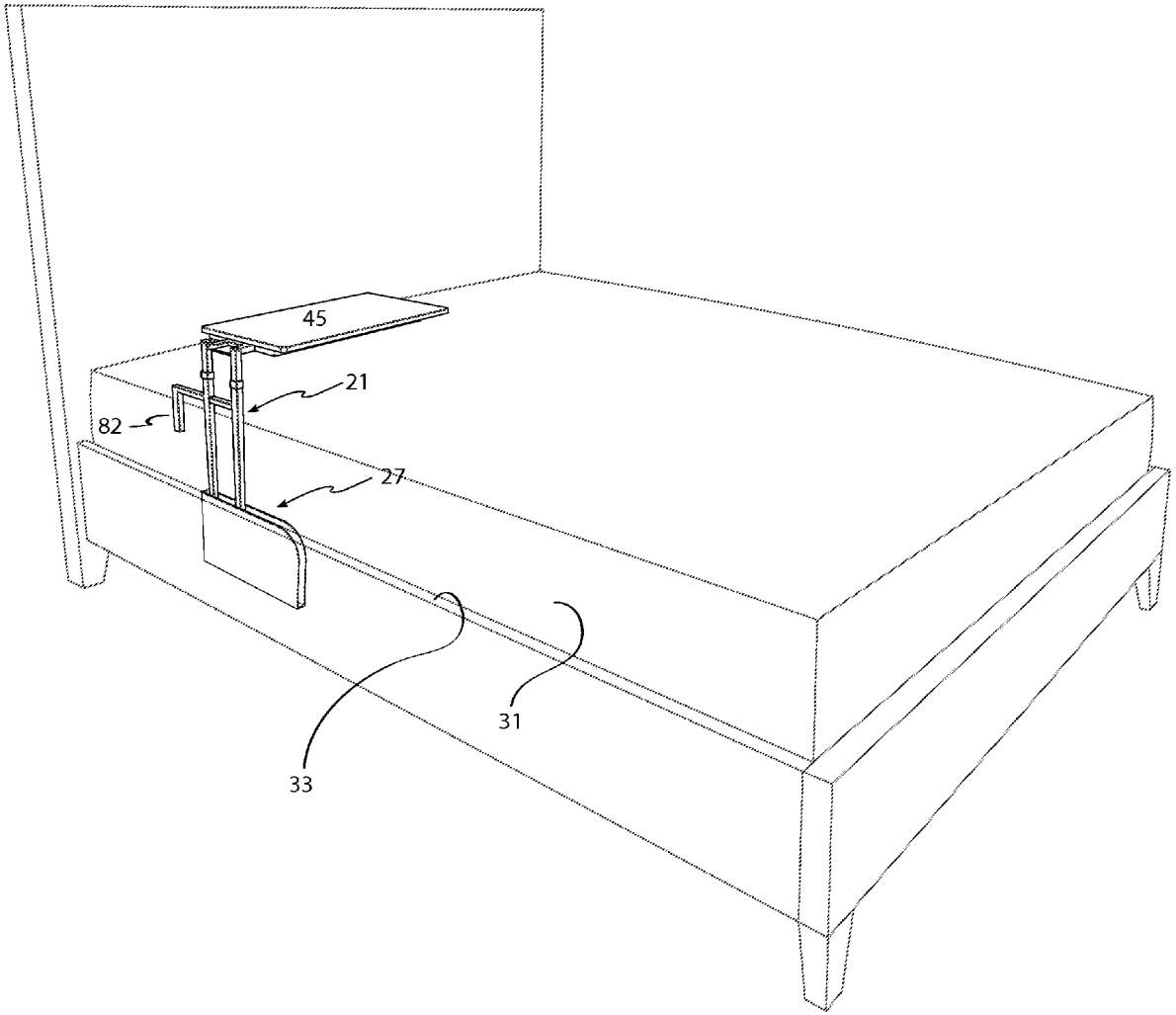
FIG. 1 is a perspective view of the retrofit table device of the present invention mounted to the space between a side of a mattress and the side rail of a bed.
Figure 2:
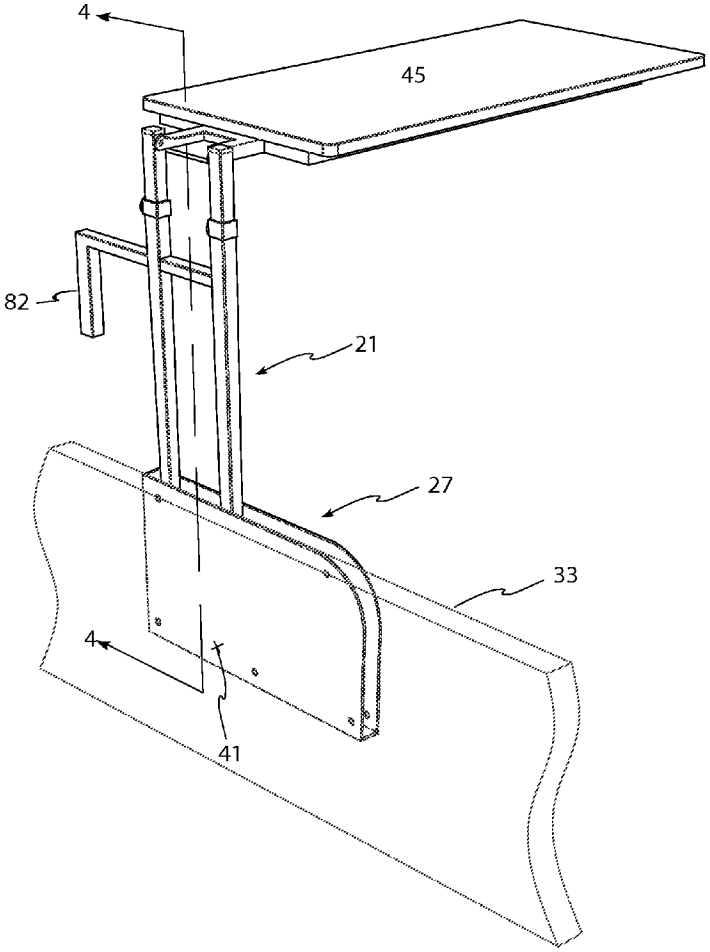
FIG. 2 is a partial perspective view similar to FIG. 1 but in enlarged scale.
Figure 3:
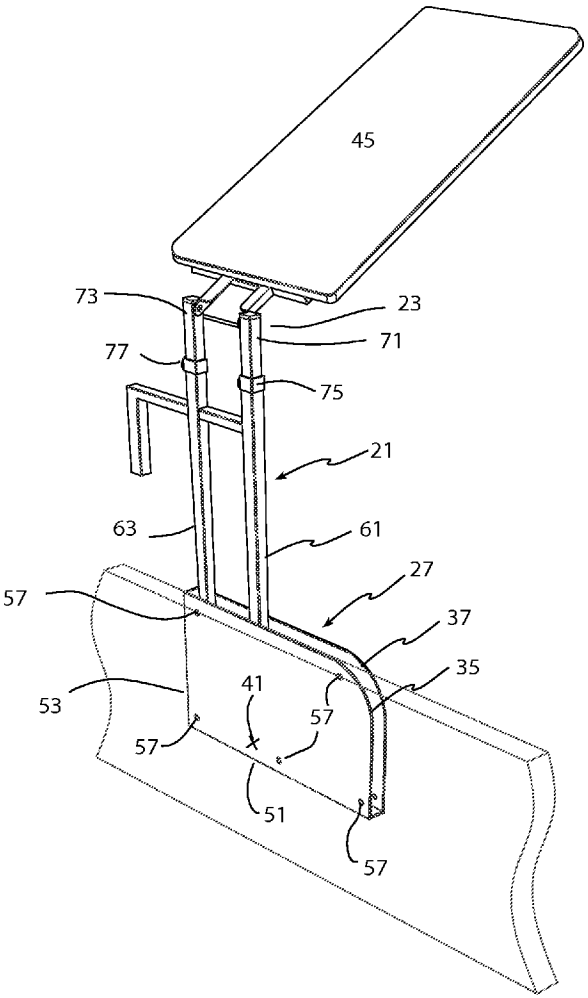
FIG. 3 is a sectional view taken in along the line of 33 of FIG. 2.
Figure 4:
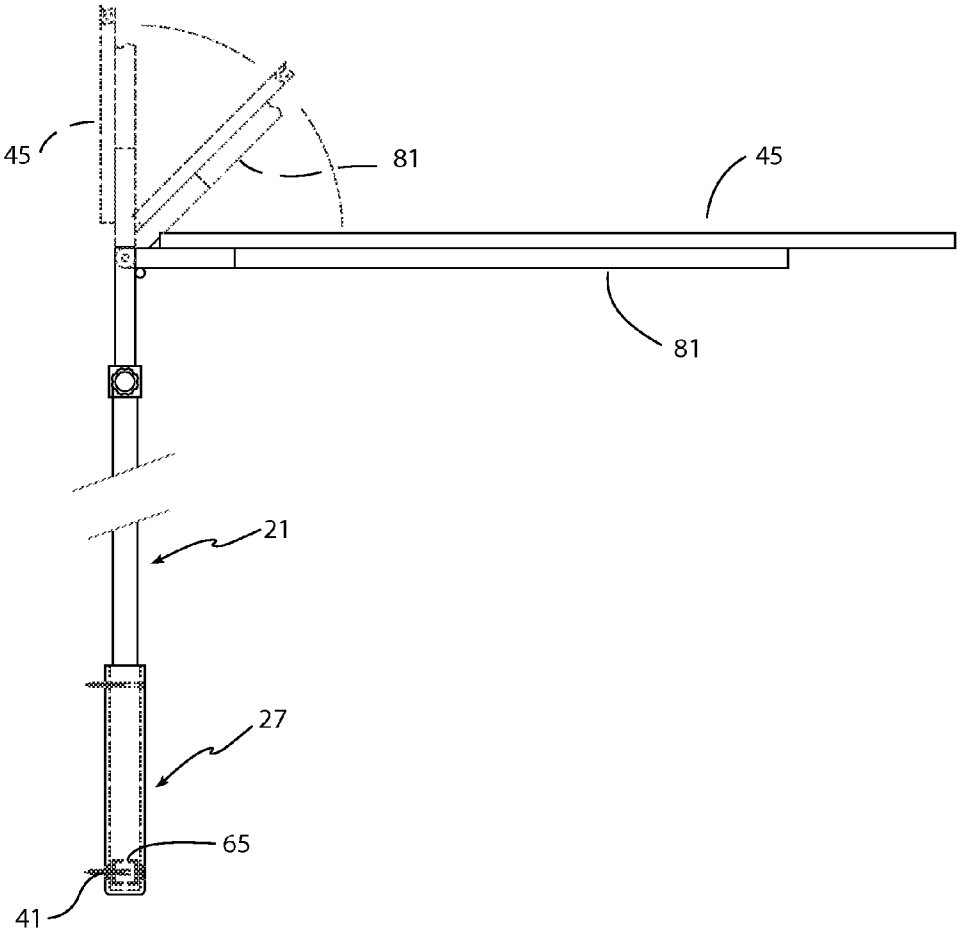
FIG. 4 is a sectional view taken from inside a rail of a bed similar to a bed similar to FIG. 1 but with the table device reversed relative to the position shown in FIG. 1, in enlarged scale.

Referring to FIGS. 1 and 3, the retrofit bed table device of the present invention includes, generally, an elongated stand 21 configured with upper and lower extremities 23 and 25. A narrow mounting box, generally designated designation 27, is fitted into the narrow space between the side of a mattress 31 and the inside surface of a rail 33 and is configured with opposite side walls 35 and 37 to receive the stand in close fit relationship. The forward side of the stand 21 at the lower extremity is connected with the box 27 by means of a pivot pin 41 so that the stand may be pivoted between the lower position shown in FIG. 5 and the raised position shown in FIG. 1. A table top 45 is pivotally connected to the upper extremity 23 of such stand.

With the aging of the American population, the need for convalescence is expected to grow significantly in the coming years thus fueling an interest in devices making convalescence more comfortable the older population. Persons 65 years and older was counted at 40 million in 2009 representing almost 13% of the US population. By 2030 it is projected that there will be about 72 million older persons, more than twice the number in 2000. Thus it would be expected that there will be more convalescence with patients confined to a bed.

There are millions of conventional or hospital beds presently in use which might be used for certain periods of time while patients are bedridden. While numerous devices have been proposed for use with beds of this type to facilitate serving meals to the patient and the like, to date none have been proposed which provide a convenient retrofit apparatus which can be inexpensively manufactured and conveniently installed in existing beds to provide a sturdy support for a table top which may be loaded with food and related materials having some significant weight and which are often loaded unevenly on the table top. It is this need for a device to retrofit beds to provide a convenient and sturdy mechanism for serving the patient's meals and the like which is solved by the present invention.

Typically, in the preferred embodiment, my device is constructed of metal or plastic or the like. Referring to FIGS. 1 and 6, the mounting box 27 is conveniently formed of sheet metal and I have found that an overall depth of about 1¼ inches will conveniently fit in the space between the inside of the bed side rail surface 33 and side of the mattress 31 to provide for convenient installation and sturdy support. In practice, the box is approximately 10 inches high and 16 inches long to provide a relatively sturdy construction. I have found that a width of between ¾ and 1½ inch is sufficient to fit most commercially available beds and to provide the necessary clearance for free movement of the stand. In the preferred embodiment, the box is formed with a bottom wall 51 and front wall 53 to add rigidity to the box itself. The configuration of the side walls, bottom wall 51 and front wall 73 leaves the top side and rear side open.

Referring to FIG. 3, the walls of the box are formed with a plurality of through clearance bores for receipt of respective fasteners 57 to secure the back wall of such box securely to the bed side rail.

Figure 7:
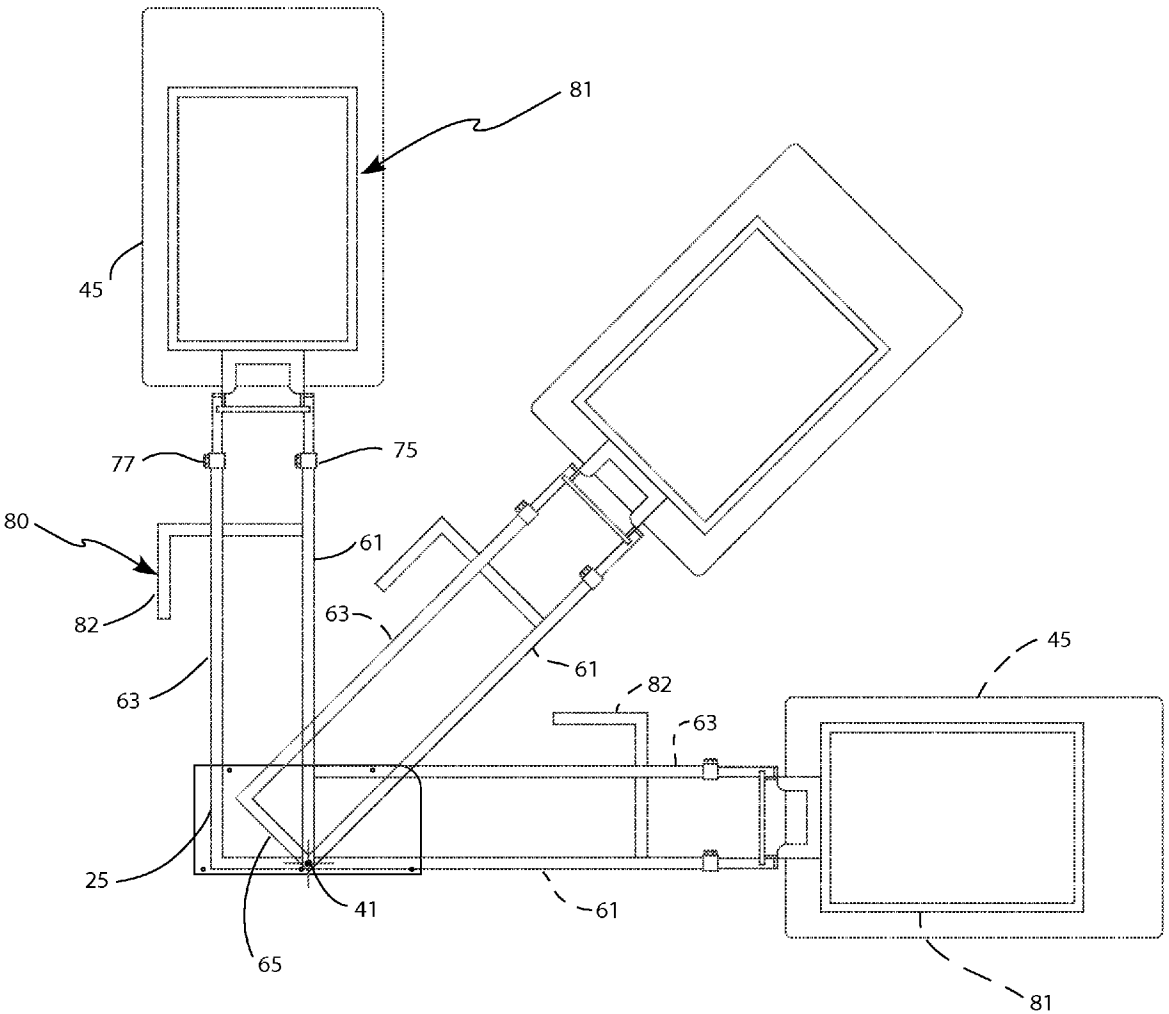
FIG. 7 is a partial sectional view similar to FIG. 6 and showing the table being raised from its retracted position to its erect position.

For my preferred embodiment, I have constructed my stand 21 with an adjusted height of between 2 and 3 feet and a width of approximately 7 inches to provide a sturdy support and a cooperative relationship with the box to afford extra support for the stand itself. For the preferred embodiment I have selected a pair of female square stem tubes 61 and 63 having a cross section of about 1 inch and a cross rung 65 connecting the lower ends of such tubes, the juncture between the rung 65 and tube 61 being configured with the pivot bore for receipt of the pivot pin 41 (FIG. 3). As will be appreciated by those skilled in the art, the stand 21 thus pivots about the pivot pin 41 as the opposite side of the stand at the intersection of the bottom rung 65 and tube 63 (FIG. 7) acts as a follower tracing a circular path having a diameter of about 7 inches (7") as the stand is rotated between its lowered horizontal position to its erect position. In practice, I construct the mounting box with only about ⅛ inch space between the opposite sides of the stand 21 and the front and back walls 35 and 37 to thus provide for free rotation of the stand while affording positive support against the top of the stand tilting inwardly or outwardly from the erect position shown in FIG. 1, even as the top of the table 45 is loaded. Furthermore, in the erect position, the lateral extent of the stand supported in the box 27 provides support against twisting of the stand within the confines of the walls 35 and 37 to thereby prevent rotation of the table 45 in the horizontal plane even if the distal free end should be bumped (FIG. 1). In practice I have found that a clearance between the sides of the stand of between 1/32 of an inch and ⅜ of an inch serves to provide the necessary clearance for free rotation while affording the necessary support for the stand to prevent tilting and twisting under normal loads.

Referring to FIG. 3, I provide my stand 21 with a pair of square male tubes 71 and 73 telescoped downwardly into the female tubes 61 and 63 and configured so that the extent of telescoping thereof can be controlled by means of respective adjustable collars 75 and 77 which include thumb screw fasteners to adjust the compression thereof for controlling the relative movement of the extension tubes 71 and 73 relative to the female tubes 61 and 63

Figure 6:
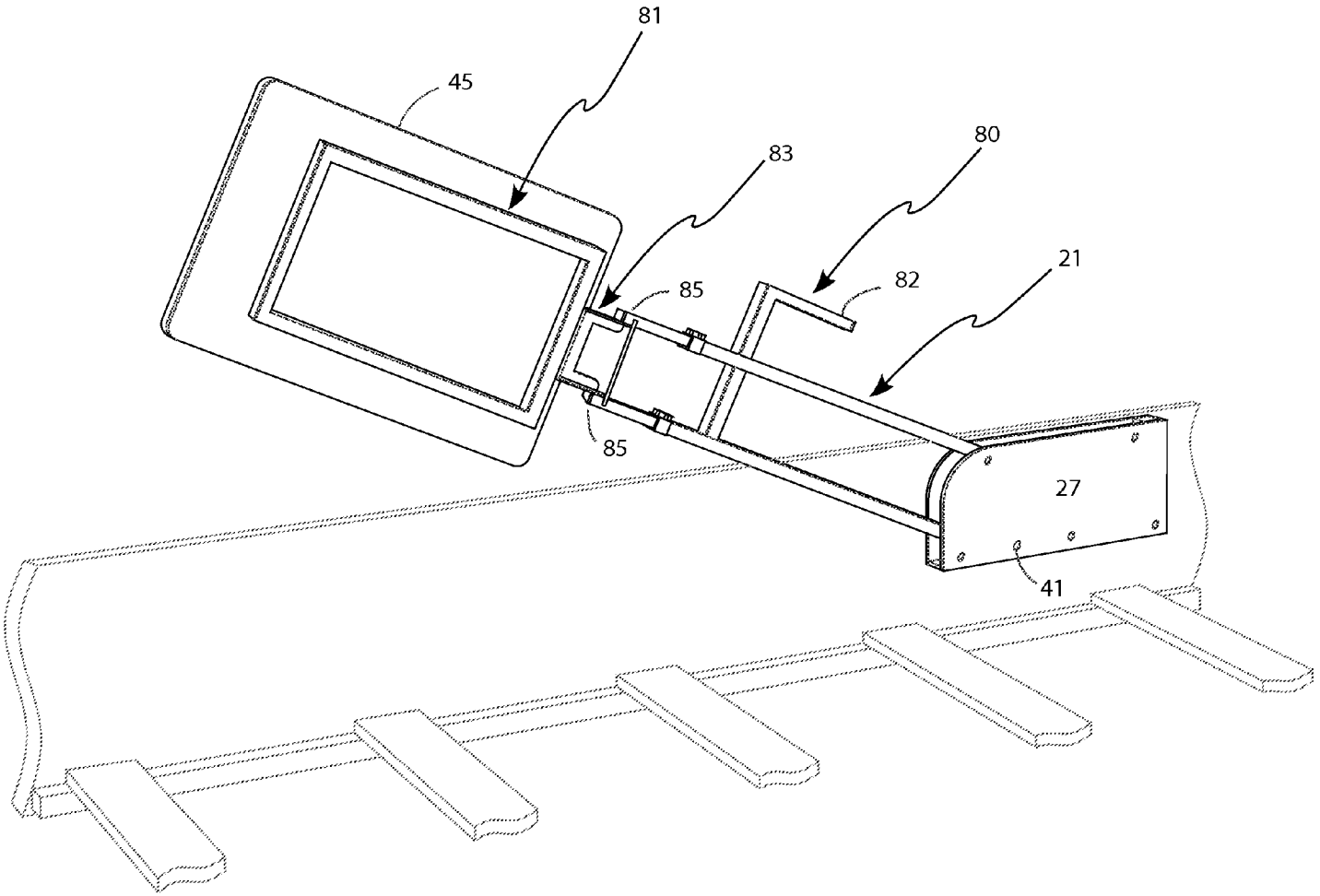
FIG. 6 is a sectional view similar to FIG. 5 but showing the table stand in a partially raised position.

Referring to FIG. 6, in one preferred embodiment I provide a square tubular frame, joint designated 81 to support my table top 45. In this embodiment, I include a connector yoke, generally designated 83, which is connected with the upper extremities of the tubes of the stand by means of pivot pins 85 for rotation of the table top between its retracted position disposed in the extended plane of the stand and its work position as shown in FIG. 1. For my preferred embodiment, I have incorporated a handle 81 attached to the stand and configured in the form of a L-shaped crank formed of square tubing and configured with a handle 82.

In operation, it will be appreciated that the retrofit table top apparatus of the present invention can be conveniently packaged in a shipping package for inventorying by a retail outlet or shipping to customers of a website and upon receipt, the installation will be relatively straightforward. As an example, the apparatus may be retrofitted to a bed by merely positioning the mounting box 27 on the inside surface 33 of the bed rail and positioned forwardly or rearwardly along the rail to the location most convenient to the patient intended to rest on the mattress 31. Fasteners may then be inserted through the pre-drilled bores 57 in the box 27 to secure the box in position on the rail and oriented with the open sides facing upwardly and rearwardly. The table 45 will then be in position for ready use or storage, supported in its raised position against the top of the stand 21 tipping inwardly as the table is loaded and against twisting should the free end of the table be bumped.

Figure 5:
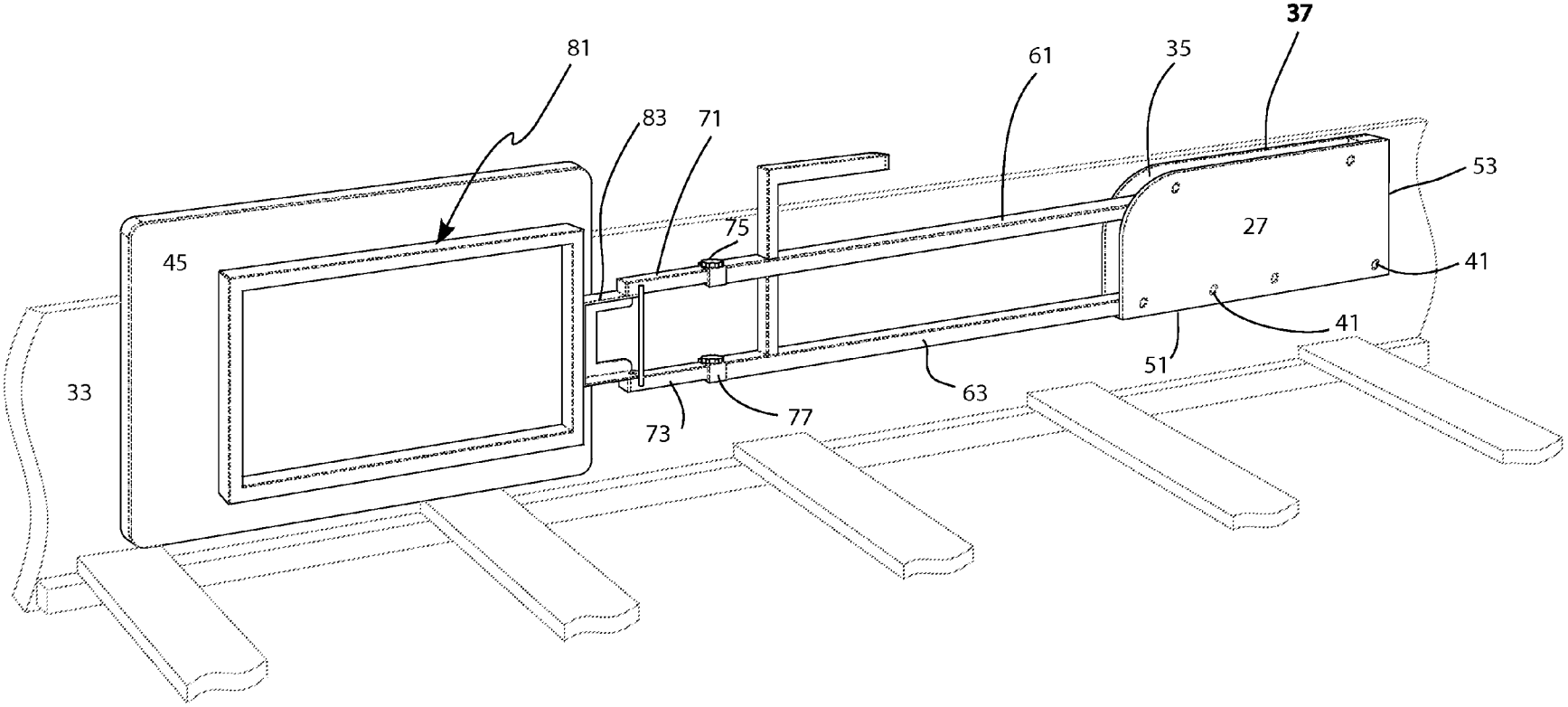
FIG. 5 is sectional view similar to FIG. 4 but with the table device in a partially raised position.

To be stored, the table will be rotated about the pivot pins 85 to its extended position co-extensive with the plane of the stand 21 as shown in FIG. 5 to be rotated downwardly along the inside surface 33 of the bed rail. When it is desirable to deploy the table top 45, the workman will grasp the handle 80 to draw the stand 21 upwardly about the pivot pin 41 as the following opposite side of the stand traces a circular pattern within the box as supported against relative movement and flexing.

As noted, when the stand 21 is rotated to the vertical position shown in FIG. 3, it will be appreciated that the side walls 35 and 37 of the box afford rigid support for the lower portions of the stems 61 and 63 of the stand to provide support against torqueing and flexing relative to the box to thereby provide a positive and rigid support for the stand and, consequently, the table 45 as it is deployed to its horizontal position as shown in FIG. 1.

Then, as the table top 41 is loaded with materials, such as, for instance, a newspaper, drinking water, a breakfast meal and other possible weights such as photographs of loved ones and the like, the table top will be firmly supported by the stand 21 as constrained within the walls 35 and 37 of the box 27 and supported by the rigid underframe 81.

From the foregoing it will be appreciated that the retrofit bed table device of the present invention provides for inexpensive manufacture, convenient and straight forward installation and in a relatively confined space and provides for firm and solid support for the table top itself.

Although the present invention has been described in detail with regard to the preferred embodiments and drawings thereof, it should be apparent to those of ordinary skill in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention.

I claim:

1. A retrofit bed-table device for fitting in the space between the side of a mattress and a bed side rail comprising:

an elongated stand constructed for positioning in the space and having top and bottom extremities and including a pair of laterally spaced apart stems and a bottom rung extending between the stems to form a pivot point at the intersection between the one lateral end of the rung and one of the stems and constructed so that a bottom the extremity of the stem opposite the one of the stems forms a follower;

a mounting box for fitting in the space and having opposite side walls configured to fit the bottom extremity of the stand in close fit relationship for rotation of the stand about the pivot point from a lowered, horizontal position to an erect, vertical position and for restraining the follower for sliding movement;

a pivot device connecting the pivot point of the stand to the mounting box; and a table pivotally connected to the top extremity of the stand for pivoting between a retracted position disposed in the extended plane of the stand and a working position disposed perpendicular to the plane of the stand.

2. The retrofit bed table device of claim 1 wherein:

the mounting box is formed with a bottom and end wall.

3. The retrofit bed table device of claim 1 that includes:

a handle mounted from the stand for grasping by a user.

4. The retrofit bed table device of claim 1 that includes:

an extension device for adjusting the longitudinal length of the stand.

5. The retrofit bed table device of claim 1 wherein:

the stems are constructed of square tubes.

6. The retrofit bed table device of claim 1 wherein:

the box is substantially one inch thick.

7. The retrofit bed table device of claim 1 wherein:

the box is formed with a plurality of bores for receiving fasteners to insert into the bed side rail.

8. The retro fit bed and table apparatus of 7 wherein:

the stand includes a handle.

9. The apparatus of claim 1 wherein:

the pivot device forms a single pivot axis.

10. The apparatus of claim 9 wherein:

the table is pivotally connected to the top extremity of the stand for rotation about a single pivot axis.

11. The retrofit bed-table device of claim 1 wherein:

the box is formed with an elongated bottom wall and the stand includes a pair of laterally spaced apart elongated stems defining opposite sides of the stand and connected together by a rung with the pivot point being located at a lower extremity of one of the stems and so configured that, when the stand is in its erect, vertical position, the rung will rest on the bottom wall and further constructed so that when the stand is in its lowered, horizontal position, the one of the stems will rest against the bottom wall.

12. A retrofit table device to fit in a space between a mattress and a bed side rail comprising:

a stand for receipt in the space and constructed of a pair of elongated laterally spaced apart square tubes formed with respective upper and lower extremities, one of the tubes being formed at its lower extremity with a pivot bore;

a mounting box for receipt in the space and configured with side walls spaced apart to receive the lower extremities of the tubes and further including a bottom wall and an end wall leaving the top of the box open and opposite the end wall open;

a pivot pin projected through the box and through the pivot bore;

a table pivotally connected to the upper extremity of the tubes for rotating from a retracted position disposed in the extended plane of the tubes and a working position disposed perpendicular to the plane of the tubes whereby the box may be installed in the space and mounted to the bedside rail to support the stand for rotation between its retracted and working positions so that the box will cooperate in supporting the tubes against torqueing and twisting the stand and table so configured that, when the mounting box is mounted in the space between the side of the mattress and the bed side rail, and the table is pivoted to the extended plane of the stand, provide for the stand to be rotated to the retracted position disposing the table in the space between the sides of the mattress and the bedside rail.

13. The retrofit bed table device of claim 12 wherein:

the mounting box is formed with bottom and end walls.

14. The retrofit bed table device of claim 12 wherein:

the stand includes a pair of laterally spaced apart elongated stems defining the opposite sides thereof.

15. The retrofit bed table device of claim 12 that includes:

a handle mounted from the stand for grasping by a user.

16. The retrofit bed table device of claim 12 that includes:

an extension device for adjusting the longitudinal length of the stand.

17. The retrofit bed table device of claim 12 wherein:

the stand is constructed of a pair of laterally spaced apart square tubes.

18. The retrofit bed table device of claim 12 wherein:

the box is substantially one inch thick.

19. The retrofit bed table device of claim 12 wherein:

the box is formed with a plurality of bores for receiving fasteners to insert into the bed side rail.

20. A retrofit bed-table device for fitting in the space between the side of a mattress and a bed side rail comprising:

an elongated stand having a lateral extent, constructed for positioning in the space and having top and bottom extremities and formed on one side of its bottom extremity with a pivot point and the opposite side of the bottom extremity forming a follower;

a mounting box for fitting in the space and having opposite side walls configured to fit the bottom extremity of the stand in close fit relationship for rotation of the stand about the pivot point from a lowered, horizontal position to an erect, vertical position and for restraining the follower for sliding movement;

a pivot device connecting the pivot point of the stand to the mounting box;

a table pivotally connected to the top extremity of the stand for pivoting between a retracted position disposed in the extended plane of the stand and a working position disposed perpendicular to the plane of the stand; and the stand and table are so configured that, when the mounting box is mounted in the space between the side of the mattress and the bed side rail, and the table is pivoted to the extended plane of the stand, provide for the stand to be rotated to the retracted position disposing the table in the space between the sides of the mattress and the bedside rail.

21. A retrofit bed-table device for fitting in the space between the side of a mattress and a bed side rail comprising:

an elongated stand having a lateral extent, constructed for positioning in the space and having top and bottom extremities and formed on one side of its bottom extremity with a pivot point and the opposite side of the bottom extremity forming a follower;

a mounting box for fitting in the space and having opposite side walls configured to fit the bottom extremity of the stand in close fit relationship for rotation of the stand about the pivot point from a lowered, horizontal position to an erect, vertical position and for restraining the follower for sliding movement;

a pivot device connecting the pivot point of the stand to the mounting box;

a table pivotally connected to the top extremity of the stand for pivoting between a retracted position disposed in the extended plane of the stand and a working position disposed perpendicular to the plane of the stand; and the box is formed with an elongated bottom wall and the stand includes a pair of laterally spaced apart elongated stems defining opposite sides of the stand and connected together by a rung with the pivot point being located at a lower extremity of one of the stems and so configured that, when the stand is in its erect, vertical position, the rung will rest on the bottom wall and further constructed so that when the stand is in its lowered, horizontal position, the one of the stems will rest against the bottom wall.

* * * * *